US008803493B2

(12) United States Patent
Zegheru et al.

(10) Patent No.: US 8,803,493 B2
(45) Date of Patent: Aug. 12, 2014

(54) VOLTAGE REGULATOR WITH DIFFERENTIATING AND AMPLIFIER CIRCUITRY

(75) Inventors: Cristi Zegheru, Bucharest (RO); Michael Lenz, Zorneding (DE)

(73) Assignee: Infineon Technologies Austria AG, Villach (AT)

( * ) Notice: Subject to any disclaimer, the term of this patent is extended or adjusted under 35 U.S.C. 154(b) by 230 days.

(21) Appl. No.: 13/106,987

(22) Filed: May 13, 2011

(65) Prior Publication Data

US 2011/0291627 A1 Dec. 1, 2011

(30) Foreign Application Priority Data

Jun. 1, 2010 (DE) ..... 10 2010 022 302

(51) Int. Cl.
*G05F 1/00* (2006.01)

(52) U.S. Cl.
USPC ..... 323/274

(58) Field of Classification Search
USPC ..... 323/234, 237, 273–274, 282, 284
See application file for complete search history.

(56) References Cited

U.S. PATENT DOCUMENTS

| | | | | |
|---|---|---|---|---|
| 5,414,354 | A | 5/1995 | Bushman et al. | |
| 5,490,055 | A * | 2/1996 | Boylan et al. | 363/41 |
| 6,541,946 | B1 | 4/2003 | Chen et al. | |
| 6,707,340 | B1 * | 3/2004 | Gough | 330/260 |
| 7,358,712 | B2 * | 4/2008 | Shimizu et al. | 323/299 |
| 7,519,301 | B2 * | 4/2009 | Keil et al. | 398/183 |
| 8,207,725 | B2 * | 6/2012 | Sullivan et al. | 323/351 |
| 2005/0030773 | A1 * | 2/2005 | Stephelbauer et al. | 363/73 |
| 2007/0057658 | A1 * | 3/2007 | Hasegawa | 323/282 |
| 2008/0258711 | A1 * | 10/2008 | Niroomand | 324/140 R |

OTHER PUBLICATIONS

U. Tietze et al.; Halbleiter-Schaltungstechnik; pp. 14-17, 544-545, 946-951; ISBN 3-540-56184-6 10. Auflage Springer-Verlag.

Robert J. Milliken et al.; Full On-Chip CMOS Low-Dropout Voltage Regulator; IEEE Transaction on Circuits and Systems, I. regular papers, vol. 54, No. 9, Sep. 2007, pp. 1879-1890.

* cited by examiner

*Primary Examiner* — Adolf Berhane
*Assistant Examiner* — Jeffrey Gblende
(74) *Attorney, Agent, or Firm* — SpryIP, LLC

(57) ABSTRACT

The invention relates to a voltage regulator having a differentiating circuit and an amplifier, the differentiating circuit being designed to detect a voltage at the voltage regulator connection and to provide it as a differentiated signal at its differentiating output, and the amplifier being designed to inject a compensation signal dependent on the differentiated signal into an input connection of an output circuit of the voltage regulator.

6 Claims, 3 Drawing Sheets

VOLTAGE REGULATOR WITH DIFFERENTIATING AND AMPLIFIER CIRCUITRY

REFERENCE TO RELATED APPLICATIONS

This application claims the benefit of the priority date of German application 102010022302.6 filed on Jun. 1, 2010, the content of which is herein incorporated by reference.

FIELD OF THE INVENTION

The present invention relates to a voltage regulator having a differentiating circuit and an amplifier.

BACKGROUND

Voltage regulators have a wide area of use in electronics for the purpose of providing a supply voltage. Voltage regulators in general can be subdivided into two classes, switched voltage regulators and non-switched or linear voltage regulators. In comparison with a linear voltage regulator, switched voltage regulators have the particular advantage that the power loss does not depend on the input voltage. In contrast, linear voltage regulators have the particular advantage that the output voltage is particularly precise and stable. Linear voltage regulators should be able to attenuate interference which occurs at their input or at their output. On account of this, linear voltage regulators can be used wherever interference occurs at the input, for example downstream of a switched voltage regulator for the purpose of smoothing the voltage spikes in an electrical system of an automobile.

As a result of the increasing use of electronics, spikes in the supply voltage also occur more and more often in battery-supported systems and have to be attenuated by a voltage regulator. One example of this is the electrical system of an automobile. All applications in which digital technology is used are affected by this since switching operations induce voltage spikes in the supply voltage. Voltage spikes or interference spikes can occur at the input, the output or the ground connection of a voltage regulator.

Interference spikes at the input of the voltage regulator occur, for example, if the input voltage is provided by a switched voltage regulator. Interference spikes at the input also occur if the input voltage is provided by a battery-supported system, this input voltage being loaded by further connected loads.

Interference spikes at the output of the voltage regulator occur, for example, if digital technology or switches is/are used at the output. The interference spikes may also be caused by other sources.

The ability of a voltage regulator to withstand these interference spikes or transient influences at its connections is reflected in the data sheet by the parameters PSSR and "Input Voltage Transient Immunity", where PSSR is the "Power Supply Rejection Ratio" which is a measure of the sensitivity of a circuit to influences of its supply voltage.

The ability of a voltage regulator to attenuate interference spikes can be improved by increasing the output capacitor. Such an output capacitor buffers the current provided by the voltage regulator, with the result that a connected load can draw the required current. An increased output capacitor has the disadvantages, inter alia, that both the costs and the space taken up on the printed circuit board increase. The regulating speed of the voltage regulator decreases.

The sensitivity of a voltage regulator to interference spikes can be improved by using an input capacitor or an input filter.

Like in the case of an increased output capacitor, both the costs and the space taken up on the printed circuit board increase.

The sensitivity of a voltage regulator to interference spikes can be improved by increasing the bias current, that current of the voltage regulator which adjusts all relevant currents of the voltage regulator being referred to as the bias current. An increase in the bias current increases the regulating speed, the current draw and the quiescent current. An increase in the current draw is undesirable in most cases.

U.S. Pat. No. 6,541,946 shows a positive feedback circuit with a high-pass filter for improving the PSSR "Power Supply Rejection Ratio".

IEEE Transaction on Circuits and Systems "Full On-Chip Low-Dropout Voltage Regulator" R. Milliken et al. shows a compensation circuit for improving the sensitivity of a voltage regulator to interference spikes.

SUMMARY OF THE INVENTION

Therefore, the present invention is based on the object of providing a voltage regulator having an improved resistance to interference spikes without requiring additional external components.

The object is achieved by means of a voltage regulator having the features of claim 1. The subclaims each define preferred embodiments.

DETAILED DESCRIPTION

The voltage regulator comprises three voltage regulator connections, an output circuit which has an input connection and is connected to a first voltage regulator connection and to a second voltage regulator connection, a differentiating circuit which has a differentiating output and is connected to a voltage regulator connection, and an amplifier having an amplifier input and an amplifier output, the amplifier input being connected to the differentiating output and the amplifier output being connected to the input connection of the output circuit, the differentiating circuit being designed to detect a voltage at the voltage regulator connection and to provide it as a differentiated signal at its differentiating output, and the amplifier being designed to inject a compensation signal dependent on the differentiated signal into the input connection of the output circuit of the voltage regulator, the amplifier having a first output stage which is designed to inject a positive part of the compensation signal into the input connection of the output circuit, and the amplifier having a second output stage which is designed to inject a negative part of the compensation signal into the input connection of the output circuit.

The voltage regulator connections are the input connection for applying an input voltage, the output connection for providing the output voltage, and the ground connection. The differentiating circuit is connected to a voltage regulator connection and has a differentiating output. The differentiating circuit may be connected to each of the three voltage regulator connections. The differentiating circuit differentiates the signal from a connected voltage regulator connection and provides it as a differentiated signal at the differentiating output. The differentiating circuit can thus detect and differentiate the input voltage, the output voltage and the ground potential.

The voltage regulator has an amplifier having an amplifier input and an amplifier output, the amplifier input being connected to the differentiating output and the amplifier output being connected to the input connection of the output circuit. The amplifier uses the differentiated signal to form a compensation signal dependent on the latter and injects this compensation signal into the input of the output circuit. In the simplest case, the output circuit may be a transistor. This transistor may be both an MOS transistor and a bipolar transistor of P-type or N-type polarity. In addition to this transistor, the output circuit may also comprise a driver circuit for driving the transistor.

The amplifier has a first output stage and a second output stage which inject a respective positive or negative part of the compensation signal into the output stage. Depending on the voltage regulator connection to which a differentiating circuit is connected and depending on the phase angle in which the differentiating circuit provides the differentiated signal at the differentiating output, the amplifiers may invert the differentiated signal, with the result that the compensation signal may be used with the same phase angle or with an inverted phase angle. The amplifiers and the differentiating circuit may be designed in their entirety in such a manner that the compensation signal is injected into the output circuit in inverted or non-inverted form.

The differentiating circuit of the voltage regulator may have a first capacitance and a second capacitance for differentiating the detected voltage, which capacitances are connected to a respective input of the first and second output stages of the amplifier. The first and second capacitances are connected to the amplifier, the capacitances injecting the differentiated signal into a respective input of the output stages.

The amplifiers may have a first voltage source and a second voltage source for setting the operating points of the first and second amplifiers and may have a first resistor and a second resistor. The first resistor connects the first voltage source to the input of the first output stage of the amplifier and the second resistor connects the second voltage source to the input of the second output stage of the amplifier.

The first and second output stages of the amplifier may each have first transistors, the base or gate being connected to the respective input of the amplifier and the collector or drain being connected to the respective output of the amplifier.

The first and second output stages of the amplifier may have second and third transistors, the respective second and third transistors being connected as current mirrors, and the output of the respective current mirror being connected to the output of the amplifier. If the output stages of the amplifier have a second transistor and a third transistor, the respective collector or drain is connected to the input of the respective current mirror, the inputs of the first transistors being connected to the inputs of the first and second output stages of the amplifier, and the inputs of the second transistors being connected to the outputs of the first transistors of the first and second output stages of the amplifier.

BRIEF DESCRIPTION OF THE FIGURES

Embodiments are explained in more detail below with reference to the following drawings, in which

FIG. 1 shows the basic structure of a voltage regulator without a differentiating circuit and without an amplifier, having an input connection 11, an output connection 12, an ground connection 13, an output circuit 21, a regulating circuit 22 and a reference voltage source 23. The output circuit 21 is connected to the input connection 11 and to the output connection 12. The output circuit essentially comprises a transistor which is also referred to as a pass device. This transistor may be both an MOS transistor and a bipolar transistor of P-type or N-type polarity. The output circuit may also comprise a driver circuit for driving. The voltage regulator has a regulating circuit 22 and a reference voltage source 23. The reference voltage source is connected to the ground connection 13 and the regulating circuit 22 is connected to the output connection 12.

FIG. 2 shows a first exemplary embodiment of a voltage regulator having a differentiating circuit 31 and an amplifier 32. An input of the differentiating circuit 31 is connected to the input connection 11 and an output of the differentiating circuit 31 is connected to an input of the amplifier 32. An output of the amplifier 32 is connected to the output circuit 21. The differentiating circuit 31 detects the voltage at the input connection 11 of the voltage regulator and differentiates said voltage. The amplifier 32 amplifies this signal and injects the amplified signal into the input of the output circuit 21. Interference at the input connection 11 is thus counteracted while circumventing the regulating circuit 22. If brief positive interference occurs at the input connection 11, it can be counteracted by the output circuit carrying less current for this moment of interference than in a steady state determined by the regulating circuit 22. If the output circuit 21 is of the P type, that is to say as PMOS or PNP, and has a current input, the amplifier 31 injects a current into the input of the output circuit 21 in the case of positive interference at the input connection 11. In the case of negative interference at the input connection 11, the amplifier 31 draws a current from the input of the output circuit 21.

FIG. 3 shows a second exemplary embodiment of a voltage regulator having a differentiating circuit 31 and an amplifier 32. An input of the differentiating circuit 31 is connected to the output connection 12 and an output of the differentiating circuit 31 is connected to an input of the amplifier 32. An output of the amplifier 32 is connected to the output circuit 21. The differentiating circuit 31 detects the voltage at the output connection 12 of the voltage regulator and differentiates said voltage. The amplifier 32 amplifies this signal and injects the amplified signal into the input of the output circuit 21. Interference at the output connection 12 is thus counteracted while circumventing the regulating circuit 22. If brief positive interference occurs at the output connection 12, it can be counteracted by the output circuit carrying less current for this moment of interference than in a steady state determined by the regulating circuit 22. If the output circuit 21 is of the N type, that is to say as NMOS or NPN, and has a current input, the amplifier 31 injects a current into the input of the output circuit 21 in the case of negative interference at the output connection 12. In the case of positive interference at the output connection 12, the amplifier 31 draws a current from the input of the output circuit 21.

FIG. 4 shows a third exemplary embodiment of a voltage regulator having a differentiating circuit 31 and an amplifier 32. An input of the differentiating circuit 31 is connected to the ground connection 13 and an output of the differentiating circuit 31 is connected to an input of the amplifier 32. An output of the amplifier 32 is connected to the output circuit 21. The differentiating circuit 31 detects the voltage at the ground connection 13 of the voltage regulator and differentiates said voltage. The amplifier 32 amplifies this signal and injects the amplified signal into the input of the output circuit 21. Interference at the ground connection 13 is thus counteracted while circumventing the regulating circuit 22. If brief positive interference occurs at the ground connection 13, it can be counteracted by the output circuit carrying less current for this moment of interference than in a steady state determined by the regulating circuit 22.

FIG. 5 shows a first exemplary embodiment of a differentiating circuit with an amplifier. The amplifier has a first output stage 44 and a second output stage 43 for amplifying the differentiated signal, which output stages are in the form of complementary bipolar transistors 43 (NPN), 44 (PNP) in this exemplary embodiment. The collectors of these transistors 43, 44 are connected and form the output 15 of the amplifier. The inputs of these transistors form the inputs of the output stages which are connected to the differentiating circuit.

Figure 1:
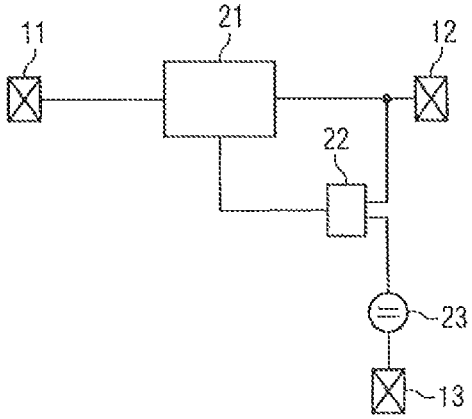
FIG. 1 shows the basic structure of a voltage regulator.
Figure 2:
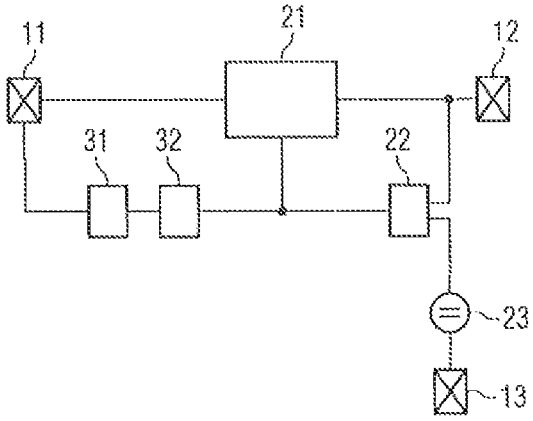
FIG. 2 shows a first exemplary embodiment of a voltage regulator.
Figure 3:
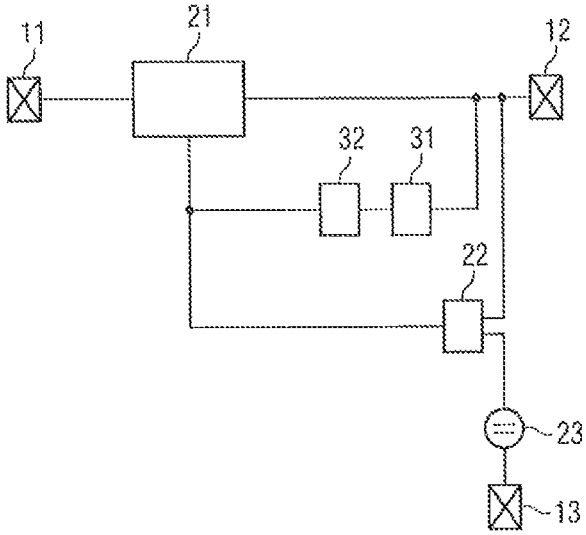
FIG. 3 shows a second exemplary embodiment of a voltage regulator.
Figure 4:
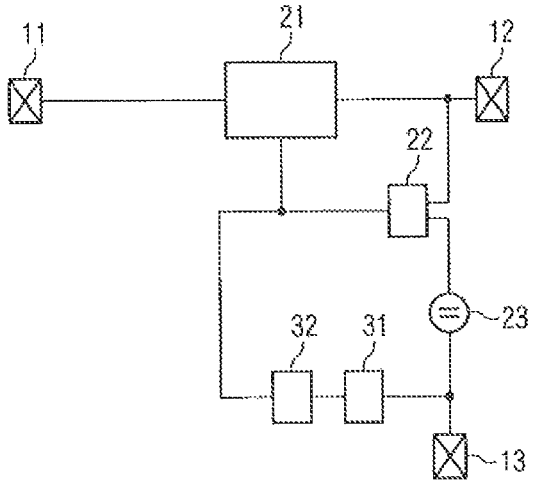
FIG. 4 shows a third exemplary embodiment of a voltage regulator.
Figure 5:
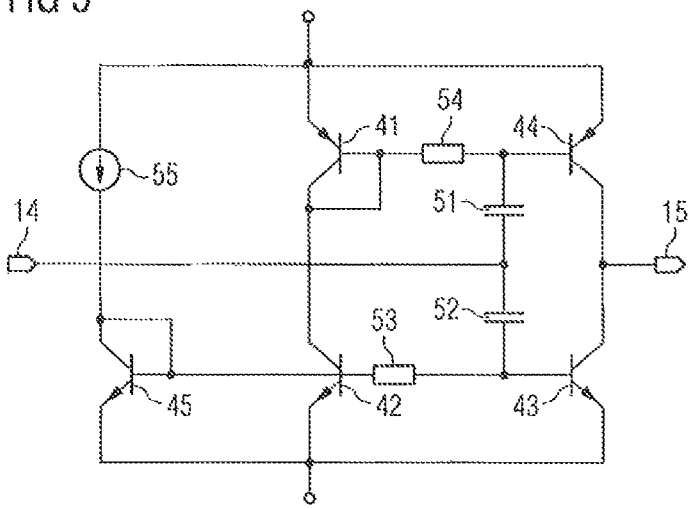
FIG. 5 shows a first exemplary embodiment of a differentiating circuit with an amplifier.

The differentiating circuit comprises a first capacitor 51 and a second capacitor 52, one respective connection of the capacitors being connected to the other connection and forming the input 14 of the differentiating circuit. The respective other connections of the capacitors are connected to the respective inputs of the output stages 43, 44. The operating points of the first and second output stages 43, 44 are set with the aid of the first to third bias transistors 41, 42, 45, the resistors 53, 54 and the current source 55. The bases of the first and second bias transistors 41, 42 are connected, with resistors 53, 54, to the respective bases of the first and second output stages 43, 44. The operating points of the first and second bias transistors 41, 42 are set using a third bias transistor 45 and the current source 55.

If the input 14 of the differentiating circuit is grounded or does not have a signal, the differentiating circuit and the amplifier are in the quiescent state. The quiescent current draw of the arrangement can be set to very low values with the aid of the current source, with the result that it does not exceed a few uA, for example. With the exception of an offset current, no current flows from the output 25 of the amplifier. The existing offset current is compensated for by the regulating circuit 22 of the voltage regulator, with the result that this current does not produce any interfering effects. The resistors 53, 54 and the capacitors 51, 52 form a respective high-pass filter which is connected upstream of the output stages 43, 44. As a result of this arrangement, the output stages are decoupled from the bias transistors 41, 42, 45 at high frequencies. At high frequencies, interference at the input 14 has a direct effect on the input of the output stages 43, 44. A high frequency is a frequency which is greater than the frequency which results from the base frequency of the capacitors 51, 52, the resistors 53, 54 and the input impedance of the output stages 43, 44 which is parallel to the respective resistor.

If positive interference occurs at the input 14, positive deflections occur at the input of the first and second output stages 43, 44, with the result that the first output stage 44 is driven in such a manner that a smaller current flows from its output and the second output stage is driven in such a manner that a larger current flows from its output, with the result that a current flows in at the output 15.

If negative interference occurs at the input 14, negative deflections occur at the input of the first and second output stages 43, 44, with the result that the first output stage 44 is driven in such a manner that a larger current flows from its output and the second output stage is driven in such a manner that a smaller current flows from its output, with the result that a current flows out at the output 15.

The first exemplary embodiment can be constructed using bipolar transistors or CMOS transistors, for example. The first exemplary embodiment of a differentiating circuit with an amplifier can be used in the first to third exemplary embodiments of a voltage regulator.

Figure 6:
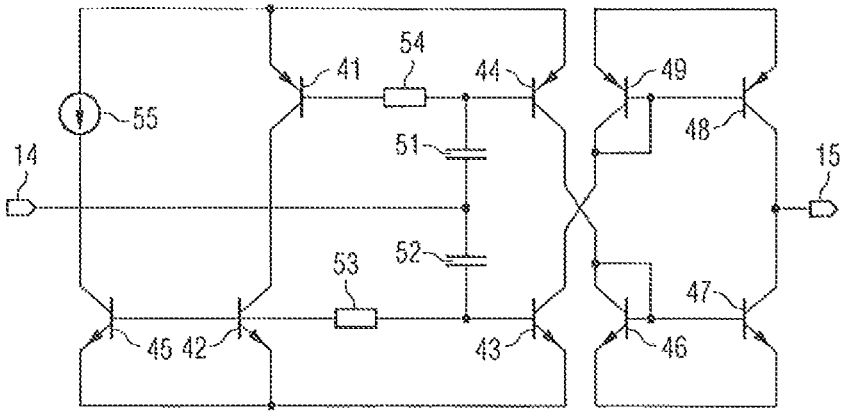
FIG. 6 shows a second exemplary embodiment of a differentiating circuit with an amplifier.

FIG. 6 shows a second exemplary embodiment of a differentiating circuit with an amplifier. Like in the first exemplary embodiment, the operating points of the first and second output stages 43, 44 are set with the aid of the first to third bias transistors 41, 42, 45, the resistors 53, 54 and the current source 55. The first output stage is formed by the transistors 44, 46, 47, and the second output stage is formed by the transistors 43, 48, 49.

A first transistor 44 of the first output stage amplifies the signal from the differentiating circuit and feeds this amplified signal, as a current, into a current mirror of the first output stage. This current mirror of the first output stage has a second transistor 46 and a third transistor 47. The second and third transistors 48, 49, 46, 47 of the first and second output stages can be connected to another reference potential.

A first transistor 43 of the second output stage amplifies the signal from the differentiating circuit and feeds this amplified signal, as a current, into a current mirror of the second output stage. This current mirror of the second output stage has a second transistor 48 and a third transistor 49.

If positive interference occurs at the input 14, positive deflections occur at the input of the first and second output stages 43, 44, with the result that the first output stage 44 is driven in such a manner that a smaller current flows from its output and the second output stage is driven in such a manner that a larger current flows from its output. The current mirrors of the output stages cause a current to flow out at the output 15.

If negative interference occurs at the input 14, negative deflections occur at the input of the first and second output stages 43, 44, with the result that the first output stage 44 is driven in such a manner that a larger current flows from its output and the second output stage is driven in such a manner that a smaller current flows from its output. The current mirrors of the output stages cause a current to flow in at the output 15.

The second exemplary embodiment can be constructed using bipolar transistors or CMOS transistors. The second exemplary embodiment of a differentiating circuit with an amplifier can be used in the first to third exemplary embodiments of a voltage regulator.

What is claimed is:

1. A voltage regulator comprising:

three voltage regulator connections one connection being an input voltage connection, one connection being an output voltage connection and one connection being an ground connection, an output circuit having an input connection, the output circuit being connected to the input voltage connection and to the output voltage connection, a differentiating circuit having a differentiating output and an input, the input being connected to one of the voltage regulator connections, and an amplifier having an amplifier input and an amplifier output, the amplifier input being connected to the differentiating output and the amplifier output being connected to the input connection of the output circuit, the differentiating circuit being designed to detect a voltage at its input and to provide it as a differentiated signal at its differentiating output, and the amplifier being designed to inject a compensation signal dependent on the differentiated signal into the input connection of the output circuit of the voltage regulator, the amplifier having a first output stage which is designed to inject a positive part of the compensation signal into the input connection of the output circuit, and the amplifier having a second output stage which is designed to inject a negative part of the compensation signal into the input connection of the output circuit, the amplifier further having a first voltage source and a second voltage source and a first resistor and a second resistor, the first voltage source being connected, by means of the first resistor, to the input of the first output stage of the amplifier, and the second voltage source being connected, by means of the second resistor, to the input of the second output stage of the amplifier.

2. The voltage regulator according to claim 1, the amplifier being designed to inject the compensation signal into the input connection of the output circuit in inverted form.

3. The voltage regulator according to claim 1, the differentiating circuit having a first capacitance and a second capacitance which are connected to a respective input of the first and second output stages of the amplifier.

4. The voltage regulator according to claim 1, the differentiating circuit being connected to the input voltage connection of the voltage regulator.

5. The voltage regulator according to claim 1, the differentiating circuit being connected to the output voltage connection of the voltage regulator.

6. The voltage regulator according to claim 1, the differentiating circuit being connected to the ground connection of the voltage regulator.

* * * * *